US006998091B2

(12) United States Patent
Iizuka et al.

(10) Patent No.: US 6,998,091 B2
(45) Date of Patent: Feb. 14, 2006

(54) LARGE BOTTLE WITH INSERT-TYPE HANDLE AND METHOD

(75) Inventors: Takao Iizuka, Matsudo (JP); Tetsuo Takahashi, Soka (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 168 days.

(21) Appl. No.: 10/231,195

(22) Filed: Aug. 30, 2002

(65) Prior Publication Data

US 2003/0006210 A1 Jan. 9, 2003

Related U.S. Application Data

(62) Division of application No. 09/618,218, filed on Jul. 18, 2000, now abandoned.

(60) Provisional application No. 60/144,243, filed on Jul. 19, 1999.

(51) Int. Cl.
*B29C 45/14* (2006.01)

(52) U.S. Cl. ..... 264/516

(58) Field of Classification Search ..... 264/516
See application file for complete search history.

(56) References Cited

U.S. PATENT DOCUMENTS

| | | | | |
|---|---|---|---|---|
| 3,140,329 | A | | 7/1964 | Nutting |
| 3,397,724 | A | | 8/1968 | Bolen et al. |
| 4,257,525 | A | | 3/1981 | Thompson |
| 4,273,246 | A | | 6/1981 | Thompson |
| 4,281,770 | A | | 8/1981 | Rainville |
| 4,363,415 | A | | 12/1982 | Rainville |
| 4,372,455 | A | | 2/1983 | Cochran |
| 4,629,598 | A | | 12/1986 | Thompson |
| 4,727,997 | A | | 3/1988 | Nakamura et al. |
| 4,805,808 | A | | 2/1989 | Larson |
| 4,909,978 | A | | 3/1990 | Hasegawa et al. |
| 4,915,241 | A | | 4/1990 | Morimura et al. |
| 4,952,133 | A | * | 8/1990 | Hasegawa et al. ..... 425/503 |
| 4,964,522 | A | | 10/1990 | Umetsu et al. |
| 4,969,922 | A | | 11/1990 | Platte, Sr. |
| 5,085,821 | A | | 2/1992 | Nohara |
| 5,092,476 | A | | 3/1992 | Yasuda et al. |
| 5,167,970 | A | | 12/1992 | Yoshino et al. |
| 5,297,686 | A | | 3/1994 | Takeuchi |
| 5,338,503 | A | * | 8/1994 | Yanagisawa et al. ..... 264/516 |
| 5,469,612 | A | | 11/1995 | Collette et al. |
| 5,535,901 | A | | 7/1996 | Ishii et al. |
| 5,560,506 | A | | 10/1996 | Yanagisawa et al. |
| 5,637,167 | A | * | 6/1997 | Krishnakumar et al. ..... 156/85 |

(Continued)

FOREIGN PATENT DOCUMENTS

JP 8-300452 8/1996

*Primary Examiner*—Michael P. Colaianni
(74) *Attorney, Agent, or Firm*—Oliff & Berridge, PLC

(57) ABSTRACT

A large plastic blow-molded bottle of at least 64 oz., preferably 96 oz. or larger, is provided with an insert-type handle that preferably extends substantially within a maximum circumference of the bottle. The bottle has a height-to-width ratio of less than 2:1. Sufficient moldability is achieved by providing a vertical elongation magnification of approximately 2:1 and a horizontal elongation magnification of at least 3:1. The bottle can be round or rectangular in shape and may include a narrow side dimension (depth) of less than about 120 mm, allowing it to fit within the side pocket shelving of most refrigerators. The bottle may have a maximum total height of 265 mm or less so that it can fit on a standard sized shelf designed for a 64 oz. bottle.

21 Claims, 7 Drawing Sheets

U.S. PATENT DOCUMENTS 5,704,506 A 1/1998 Tobias et al.
5,711,061 A * 1/1998 Blake et al. ..... 29/516
D402,895 S 12/1998 Takahashi et al.
D404,308 S 1/1999 Takahashi et al.
D405,690 S 2/1999 Takahashi et al.
D405,691 S 2/1999 Takahashi et al.
D407,650 S 4/1999 Takahashi et al.
6,004,638 A 12/1999 Kaya et al.
6,012,597 A * 1/2000 Nishihara et al. ..... 215/398
6,179,143 B1 * 1/2001 Grob ..... 215/398

* cited by examiner

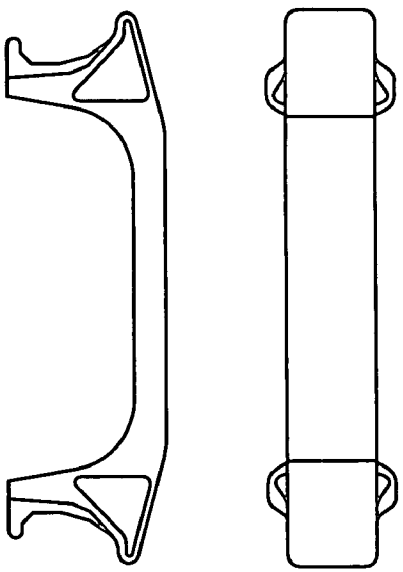
D - TYPE
Fig. 8E Fig. 8F
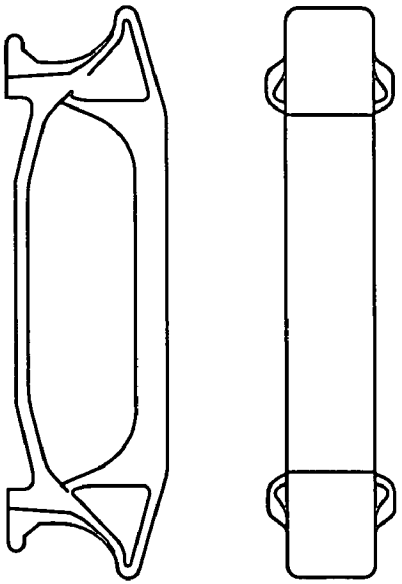
KD - TYPE
Fig. 8C Fig. 8D
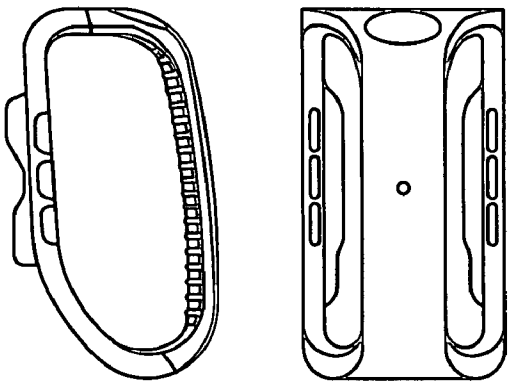
Y - TYPE
Fig. 8A Fig. B

LARGE BOTTLE WITH INSERT-TYPE HANDLE AND METHOD

This is a Division of application Ser. No. 09/618,218 filed Jul. 18, 2000, now abandoned. The entire disclosure of the prior application(s) is hereby incorporated by reference herein in its entirety.

This nonprovisional application claims the benefit of U.S. Provisional Application(s) No. 60/114,423 filed Jul. 19, 1999.

BACKGROUND OF THE INVENTION

1. Field of Invention

A large blow-molded plastic bottle of at least two liters, preferably 96 or 128 ounces, that includes an insert-type handle, has a height-to-diameter of less than 2:1, and expansion ratios that allow good moldability.

2. Description of Related Art

Food containers (bottles) of glass have been replaced by plastics for reasons of cost and safety. In particular, many containers with a capacity of one liter or more are now being manufactured from plastics (mainly, PET). At the beginning of development, due to cost and molding technology deficiencies, a large one gallon bottle (approximately four liters) was formed with a round shape, which was difficult to carry and had a handle affixed to the bottom of the mouth (or just below the neck) after the bottle was formed. However, a recent technology has been developed in which a bottle for shochu (e.g., liquor) or soy sauce is formed with a handle attached. In Japan, many large shochu containers and 1.8-litter soy sauce containers have been converted into containers with a handle.

Given this background, there arose a demand for a large bottle, such as a 96 oz. juice bottle, with a handle with which a customer could easily pour liquid. However, compared to a bottle of alcohol or the like, which is generally thin and long in order to have a sophisticated appearance, a beverage or food bottle is designed to be short, and shelves in supermarkets and convenience stores for such bottles are also designed to be shorter. Moreover, juice containers require high heat pasteurization processes and thus often require bottles having high heat resistance.

Attempts to affix a conventional handle to a large beverage or food bottle of two liters or more resulted in a very difficult design, with the overall height of the bottle becoming large as a solution.

A trend toward short bottles can be seen in Europe and in the United States. Particularly, in the United States, with respect to one gallon bottles, the height is approximately 290 mm compared to the Japanese two-liter bottle with a height of 305 mm. Despite being approximately double the capacity, the cost of these bottles is lower. While large diameter bottles with low height and an integrally molded handle are known, applicants are aware of no example of a large-diameter bottle with a low overall height using an insert-type handle.

There are problems with current bottles, particularly 96 oz. bottles. An explanation of these problems will be given below using as examples four bottles (see Table 1). Two of the bottles are large U.S. bottles of two liters (64 ounces) or more without insert-type handles. The last two bottles include a large four-liter bottle widely-used for shochu and a 1.8-liter bottle used for soy sauce. Both of the latter bottles are provided with an attached insert-type handle.

Table-1 shows the height of the bottles, excluding the mouth, and the maximum diameter of the above four conventional bottles. It can be seen that the height-to-diameter (H/D) ratio of a bottle with a handle (the 4 L shochu or 1.8 L soy sauce bottle) is more than 2:1. It would also be desirable to have insert-type handles on the other large bottles. However, the two bottles to which a handle is desirable (the 96 oz. and 1 gal. bottle), have a height-to-diameter (H/D) ratio that is less than 2:1. Thus, for these latter two bottles, the diameter is large and the height is short.

TABLE 1

Ratio H/D between height (H) and bottle diameter (D)

| | Shochu 4 liters (w/handle) | Soy Sauce 1.8 liters (w/handle) | 1 gallon (w/o handle) | 96 oz. (w/o handle) |
|---|---|---|---|---|
| Diameter (D) | 142 | 106 | 157 | 140 |
| Height (H) | 345 | 290 | 266 | 254 |
| H/D | 2.43 | 2.74 | 1.69 | 1.81 |
| Neck diameter (d) | 40.3 | 31.5 | 46.0 | 40.5 |
| D/d | 3.52 | 3.36 | 3.41 | 3.46 |

A bottle with an insert-type handle has not previously been realized when the height of the bottle was short and the diameter was thick, that is, when the H/D ratio was less than two.

A current method of forming a bottle having an insert-type handle involves inserting a preform, which has been heated to approximately 110° C., into a metal mold simultaneously with an insert handle and blow-molding the preform into a bottle (see FIGS. 1–2). During this molding, resin that has been molded is pressed into an undercut part of the insert-type handle 200, making it difficult for the handle 200 to come off.

With reference to FIG. 2, in such a molding method, if the outer diameter of the preform 100 contacts the handle 200, rubbing damage, scratching or the like occurs in the preform 100 and the handle 200, which results in a bottle 300 of lesser commercial value. Therefore, a distance 220 between the insert-type handle 200 and the preform 100 needs to be at least approximately 2 mm, and preferably approximately 5 mm. Additionally, a space 240 between the bottle 300 and a gripping part 260 of the handle should be at least 20 mm and preferably 25–30 mm, to allow a customer to easily grip the bottle by inserting his or her fingers into the space. Furthermore, when a bottle engaging part 280 of the handle and the gripping part 260 of the handle are combined, approximately 15–20 mm of space is needed. Accordingly, the maximum diameter or width of bottle 300 is the maximum diameter of preform 100 and the distance 220 between the handle 200 and preform 100 in addition to the total depth of handle 200. While the function of handle 200 can still be achieved if the handle protrudes from the maximum circumference of the bottle 300, this causes problems when the bottle needs to be boxed, and during a filling procedure in a bottle filling line. Therefore, it is preferable that handle 300 does not protrude from the maximum periphery of the bottle.

Taking the above into consideration, because the neck diameter d is substantially determined by the mouth diameter, the maximum diameter D of the bottle can be established by the following equation:

$$D=(d/2+(35\sim45)+2\sim5)\times2 \quad (1)$$

With respect to the maximum diameter (D) of the bottle, when the mouth diameter is determined, the neck diameter logically follows. The exemplary soy sauce bottle and shochu bottles from Table 1 are calculated to have maximum diameters of 105.5 and 140.3, respectively, using equation 1. These numbers are close to the actual bottle diameters.

As described earlier, because the height of a bottle is determined in accordance with the height of an exhibition shelf, when the capacity of the bottle becomes large, the bottle accordingly has to be made larger in diameter.

However, for reasons relating to bottle moldability, the relationship H/D of the height and the diameter of the bottle for most bottles results in a H/D ratio of two or more. This is because, in extrusion blowing technology, the preform is stretched approximately twice its original length in a vertical direction and three to four times its original length in a horizontal direction to achieve appropriate expansion ratios in terms of bottle moldability. Furthermore, bottles that have been designed according to expansion ratios have a H/D ratio of 2 or more, and preferably 2.3.

The graph of FIG. 3 is a graph showing the relationship of the bottle height and volume (unit: ounces) of a heat resistant bottle in the United States. The solid line shows the current height of the bottle and a broken line shows a preferable height of the bottle, from the standpoint and objective of easy molding of the bottle.

According to this graph, even if the volume of the bottle becomes large, the height of the bottle does not become taller in proportion to the volume of the bottle. That is, when a bottle that needs a handle becomes 64 ounces (approximately 2 liters) or more, there is a tendency for the ratio of the height to the diameter/width to become smaller, and moldability accordingly decreases.

From the above description, it should be understood that a problem comes into existence when an insert-type handle is placed in a short bottle, as the handle constrains the size and shape of the preform used. It also will be understood that when a bottle 300 with a handle 200 is molded, the maximum diameter/width of the bottle is determined by a mouth diameter and the height of the bottle is determined by problems in molding.

The above description only discusses the external dimension aspect of the bottle. If the thickness of the bottle is ignored, the above theory is not related. If a bottle is made of a material such as a plastic bag, there is no problem, but in order to support a weight of two kilograms or more, it is necessary to have some thickness.

In terms of calculations, the desired expansion ratio can be accomplished if the thickness of the preform is made to be thick. However, when the thickness of preform 100 is more than 5 mm, using materials which are commonly available, the molding cycle becomes longer. In addition, this extra thickness causes a cooling insufficiency, which causes unclearness or cloudiness in the molded bottle 300. Therefore, it is not possible or desirable to make preform 100 very thick.

Because of the above problems, including size constraints of the preform 100 due to the provision of an insert-type handle 200 into the mold, the design of a preform 100 for a large bottle with an insert-type handle 200 and a H/D ratio of less than 2:1 is very difficult and the moldability of preform 100 is poor. That is, it is extremely difficult to form a bottle with an insert-type handle using this type of poor preform, and stable molding was not previously thought to be attainable.

Thus, the production of this type of large bottle with a low H/D ratio and an insert-type handle has not previously been realized.

SUMMARY OF THE INVENTION

Because of customer demand, it has become necessary to develop a large bottle of at least 64 ounces, preferably a 96 or 128 ounce bottle, with an insert-type handle. It is also desirable from a customer standpoint for the bottle to have an overall height (including the mouth measurement) that is short (preferably 265 mm or less for a 96 oz. bottle) so that the bottle can fit on the same shelf as smaller conventional bottle (such as a 64 oz. bottle). This invention was achieved after spending many years of research and testing responding to a strong demand from customers for such a product.

With respect to a 96 ounce grip-type bottle in the current market, which has a H/D ratio of approximately two (277.5/137), it was thought that the design would be possible using a maximum bottle diameter of 123–143 mm as calculated from a neck diameter of 40.5 mm.

FIG. 4 is a graph showing the volume of the bottle (in ounces) and the weight of the bottle (in grams) excluding the mouth part. The relationship of both is substantially linear and proportional according to the graph of FIG. 4. The following relationship can be established:

$$Y=0.878X+12.08 \quad (2)$$

According to this equation, where Y is the calculated weight and X is the desired volume, if the weight below the neck is calculated for a 96-ounce or 128-ounce bottle, to which a handle could not heretofore be molded with a H/D of less than 2.0, 96.4 grams and 124.5 grams are obtained, respectively.

However, when the height of the bottle is limited to a height that can enter a shelf, the diameter of a large bottle has to become large to obtain the necessary volume, as discussed earlier. Furthermore, when the diameter is determined, the maximum diameter of the preform, that is, the neck diameter, is determined. From this, the mouth diameter is naturally determined. As discussed earlier, if a preform does not contact a handle, the preform diameter can be small, but if the diameter is made to be too small, an appropriate expansion ratio cannot be obtained. Furthermore, in addition to the expansion ratio, the molding of the preform will be affected as well when the mouth diameter is small because the thickness of the preform will be required to become thick to attain desired weight and the molding time will be longer.

For example, the current 96 ounce grip-type bottle from Table 1 (without an insert-type handle) has a height of 254 mm, an outer diameter of 140 mm, and a mouth size of 43 mm. Here, the weight of the preform is calculated to be 96.4 grams according to equation 2. This is a normal round-shaped weight, but in reality, a grip-type bottle in the current market weighs approximately 10 grams more than this due to provisions of the grip. Based upon these results, when preform 100 is designed, two types can be considered: the one shown in FIG. 5A, which has a relatively long length and a relatively narrow diameter, and the one shown in FIG. 5B, which has a relatively short length and a relatively wider diameter. However, type A, shown in FIG. 5A, is not preferable because the expansion ratio in the vertical direction is low when used to form a bottle having a H/D of less than 2:1, which will cause moldability problems. However, even if type 2 was used, shown in FIG. 5B, the vertical expansion ratio was still only approximately 1.77 times the original vertical height. Compared to a 4-liter shochu bottle and a 1.8-liter soy sauce bottle, this is still low and does not reach a desired expansion ratio, and the moldability is less than desired.

When a bottle with an insert-type handle and a 43-mm mouth was designed, the maximum diameter of the bottle was calculated to be 143 mm. Compared to a 96-ounce bottle in the current market with a maximum diameter of 137 mm and a height of 295 mm, it was believed to be almost impossible to obtain the desired 96 oz. volume in a bottle having a height of less than 265 mm (30 mm shorter) when the mouth diameter could only be increased from 137 mm up to the calculated maximum of 143 mm (only 6 mm difference). As such, it was believed necessary to change the basic design of the current bottle.

Furthermore, with respect to the weight of the preform with the current 43 mm mouth diameter for a one-gallon size, if the original mouth weight of 124 grams is decreased by 9 grams (the weight of the mouth), the weight below the neck becomes 115 grams. When a bottle is designed with this weight, because the expansion ratio in the vertical direction is lowered to 1.61, the moldability becomes extremely poor.

As described above, as the height of the bottle becomes shorter, the volume cannot be ensured with respect to a 96-ounce or larger bottle with the current 43-mm mouth diameter. In addition, as the expansion ratio in the vertical direction decreases, the moldability of the blow molded bottle also becomes extremely poor. Therefore, this design was not suitable for actual production.

A first aspect of the invention relates to a large plastic blow-molded bottle having an insert-type handle, and a method of manufacture therefor. The blow-molded bottle has an insert-type handle extending substantially within a maximum axial dimension (width) of the bottle. Also, the bottle has a height-to-width ratio (as measured using a width measurement taken in line with the insert-type handle) of less than 2:1 and a volume of at least 64 oz., preferably 96 oz. or more. Moreover, the bottle has a vertical elongation magnification of approximately 2:1 and a horizontal elongation magnification of at least 3:1 to allow sufficient moldability and heat resistance. When the volume is about 96 oz., the total height is preferably less than 265 mm to allow the bottle to be used on the same shelves as conventional 64 oz. bottles.

An exemplary design was made using a round 96-ounce bottle with a maximum bottle width of 157 mm, which is the same as a current one gallon bottle, and a bottle height of 254 mm, which is less than the desired 265 mm shelf size. The bottle was formed from a preform having a preform neck diameter of about 45 mm. The vertical expansion ratio of the preform and the bottle was calculated to be 1.97, whereas the horizontal expansion ratio was calculated to be 3.50. Both of these are appropriate and resulted in good moldability of the bottle.

Another problem to be overcome was the need by the customer for a large bottle that can fit into a side pocket of a refrigerator, which typically has a width of less than 120 mm. Thus, not only does the bottle height have to be below 265 mm to fit into a commercial shelf, but the maximum diameter has to be less than 120 mm.

Accordingly, another aspect of the invention relates to a large bottle, preferably a 96 oz. bottle, formed with an insert-type handle, and a method of manufacture therefor, having a height of less than 265 mm and capable of fitting in a refrigerator side pocket, which has a maximum width of about 120 mm.

This was achieved in one exemplary embodiment by using a 48 mm diameter mouth, which resulted in a blown bottle having a height of 260 mm (which is less than the maximum of 265 mm needed to fit on a conventional 64 oz. shelf), and 120×156 mm rectangular sides (which provides a short side able to fit in the 120 mm wide refrigerator side shelves). This exemplary bottle resulted in a vertical expansion ratio of 2.0, and a horizontal expansion ratio of 3.48. These expansion ratios are also appropriate and resulted in good moldability of the bottle.

Another aspect of the invention is to provide a proper shape of the insert-type handle for the bottle. The first and second aspects primarily were concerned with the shape of the preform and bottle. However, the shape of the handle is also important and several types of insert-type handles are available. It was determined that a Y-type insert is the most suited for such a large container, particularly when a circumferential label area is necessary.

These and other features and advantages of the invention are described in or are apparent from the following detailed description of the exemplary embodiments, which are intended to be illustrative and non-limiting.

BRIEF DESCRIPTION OF THE DRAWINGS

Various exemplary embodiments of the invention will be described in detail, with reference to the following figures, wherein:

FIGS. 8A–8F are side and end views of various types of insert-type handles used with blow-molded bottles.

DETAILED DESCRIPTION OF PREFERRED EMBODIMENTS

Figure 6B:
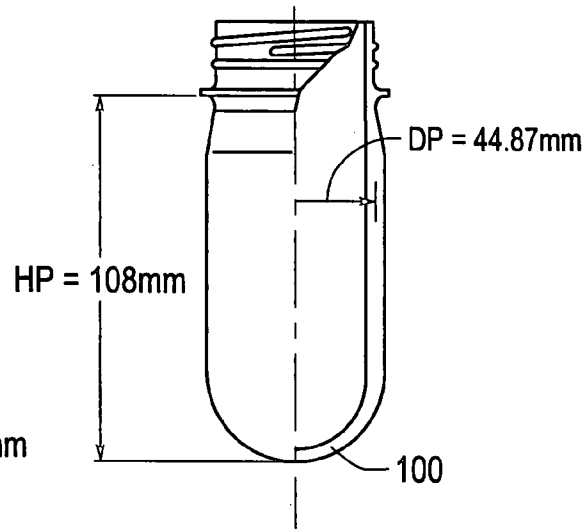
FIG. 6B is a blown 96 oz. bottle formed from the preform of FIG. 6A according to the first embodiment of the invention.
Figure 6A:
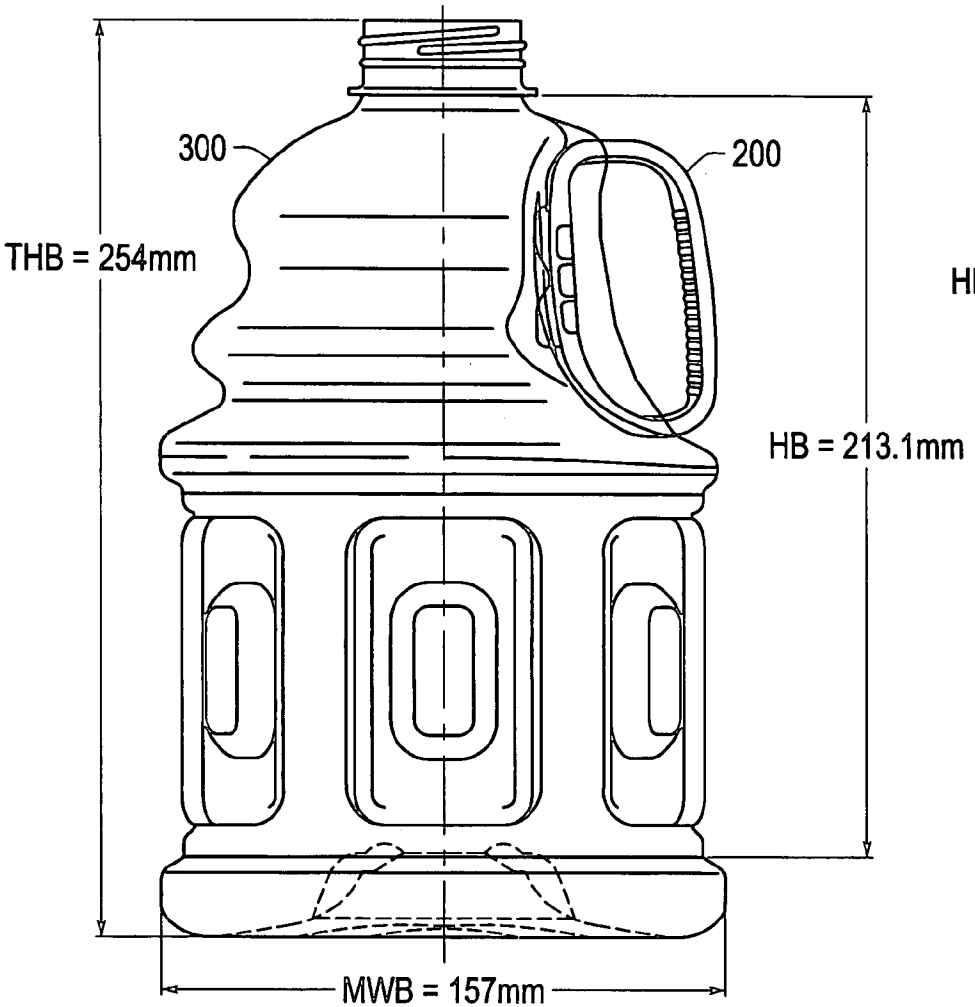
FIG. 6A is a partial cross-sectional view of a preform according to first and second embodiments of the invention.

A first aspect of the invention will be described with reference to FIGS. 6A and 6B, in which a large bottle of at least 64 oz. is formed with an insert-type handle. It is desirable for some of these bottles to have a height of 265 mm or less, so that the bottle is able to fit a standard-sized shelf for a 64 oz. bottle. However, due to the height restriction and the necessity for such a large volume, the H/D ratio of the bottle must become less than 2:1, which has previously resulted in difficulties in moldability. As such, an important feature of the invention is the design of a preform and bottle configuration that results in a final bottle having a H/D of less than 2:1, while still achieving suitable expansion ratios, which for hot-fill applications are about 2:1, preferably 1.8:1 and above, and more preferably between 1.8:1 and 2.3:1 in the vertical direction and between 3.0:1 and 4.0:1 in the horizontal direction, to attain desirable moldability. Lesser expansion ratios can be used for non hot-fill applications.

An exemplary design was made using a substantially round 96-ounce bottle with a maximum bottle width MWB of 157 mm, which is the same as a current one gallon bottle, and a total bottle height THB of less than 265 mm.

Figure 5A:
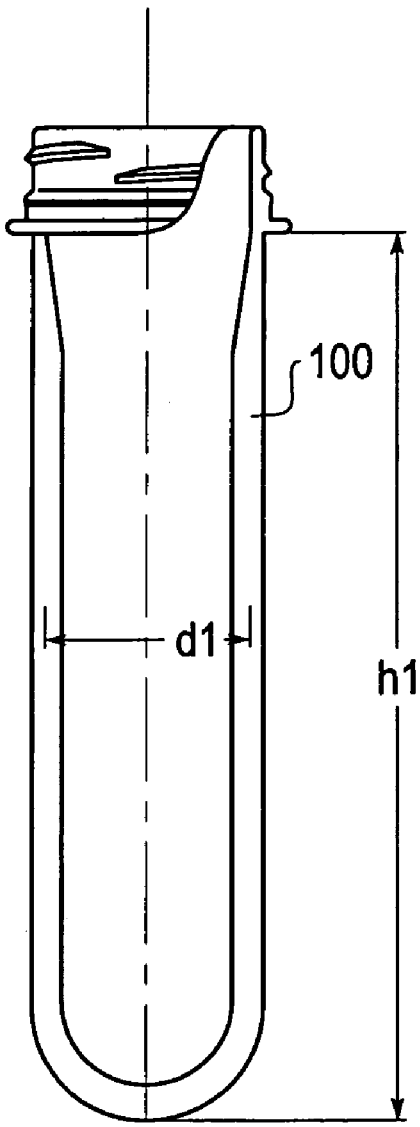
FIGS. 5A and 5B show two types of preforms that can be used to form a blow-molded bottle.
Figure 5B:
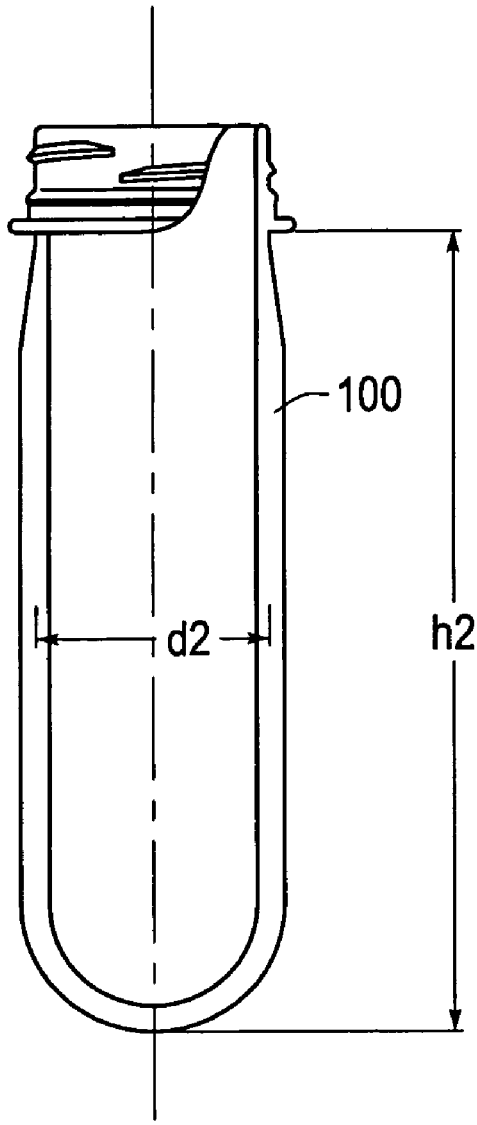

For a maximum bottle diameter of 157 mm, the maximum neck diameter of the preform is desired to be 55 mm or less according to equation 1. Furthermore, with respect to the shape of preform 100, when the height of the bottle is short, type B as in FIG. 5B can be designed to have a higher vertical expansion ratio, so this preform type in which the core side is straight is appropriate.

Here, if the bottle is designed with a preform below-neck weight of 96.4 grams, which is the determined weight using equation 2 for a 96 oz. bottle, it is also predicted that the thickness of the preform will be 5 mm or more, which is undesirable. Therefore, taking this thickness into consideration, the neck ring diameter ND must be 50 mm or less.

A suitable range for the neck diameter was found to be the screw minor diameter of the preform ±2 mm. Thus, for large bottles of at least 64 oz. capacity, the neck diameter has a suitable range between 38 to 48 mm. From this, suitable mouth diameters were found to be between 43 to 48 mm. At the lower end, a 38 mm neck diameter is preferable for a 64 ounce bottle having a mouth diameter of 43 mm and a screw minor diameter of 40.4 mm. At the higher end, a 48 mm neck diameter is preferable for a one-gallon bottle having a mouth diameter of 48 mm and a screw minor diameter of 46.15 mm.

In the case of a 48 mm mouth, the weight of the mouth alone is 13.3 grams. Therefore, using the calculated weight above, the total weight of the preform becomes 96.4+13.3=109.7≅110 g. Based upon the above data, a preform 100 and a bottle 300 shown in FIGS. 6A and 6B were designed. The chosen preform 100 had a preform diameter DP of approximately 45 mm (actually 44.87 mm) and a below mouth preform height HP of 108 mm. The preform 100 was molded into a bottle using a polyethylene terephthalate (PET) material. The vertical expansion ratio from the preform to the bottle is calculated to be 1.97 (213.1/108). The horizontal expansion ratio is calculated to be 3.50 (157/44.87). These form appropriate expansion ratios allowing sufficient moldability for hot-filled applications.

To form bottle 300, the following exemplary method was performed. Preform 100 was heated to approximately 110° C. The handle 200 and preform 100 were then simultaneously placed into a metal mold, created to have a shape capable of forming the bottle of FIG. 6B, and preform 100 was blown for approximately 3 seconds at a 30 kg/cm$^2$ blow pressure and a temperature of approximately 120° C. After that, the inside of the blown bottle 300 was cooled down at room temperature for approximately one second and the bottle was taken out from the metal mold.

The thus formed bottle 300, with an integral insert-type handle 200, was found to have a heat resistance of 82° C. or more. While a heat resistant bottle was desired for this particular application to allow for pasteurization, it is merely one example. Other formation conditions can be used to further increase the heat resistance of the bottle or to eliminate the heat resistance characteristic. With respect to desired further higher heat resistant temperatures, the metal mold temperature can be increased. With respect to a non-heat resistant bottle, or when lesser heat resistance is desired, the mold temperature can be decreased. In some instances where lower molding temperatures occur, cooling of the bottle after the blow molding may not be needed.

A second exemplary design was made using a round 128-ounce bottle that also achieves a H/D of less than 2:1, while still achieving suitable expansion ratios. The 128-ounce bottle had a maximum bottle width MWB of 158 mm and a total bottle height THB of 290 mm (H/D=290/158=1.84). The 128-ounce bottle had a screw minor diameter of 46.15 mm and a 48 mm neck diameter. Vertical expansion ratios were between 1.8 to 2.3 and horizontal expansion ratios were between 3.0 to 4.0, which allowed sufficient moldability. This bottle can be formed by the same method used to form the 64-ounce bottle.

Another aspect of the invention is to achieve a large bottle, preferably a 96 oz. or larger bottle, having a height of less than 265 mm, formed with an insert-type handle, and capable of fitting in a refrigerator side pocket, which normally is less than 120 mm. This aspect will be discussed with reference to FIGS. 7A–7C.

Because the height is determined, i.e., less than 265 mm, adjustment of the volume can only be achieved by making the bottle rectangular or elliptical, rather than round. In the case of making bottle 300 elliptical, there is a waste because of line characteristics and methods of boxing bottles. Accordingly, the most effective design was found to have a substantially rectangular cross-section. However, when the long diameter is too long, the moldability decreases and mold formation becomes difficult. An exemplary bottle was made with a long side width of 156 mm, substantially the same as in the previous example, but with a 48 mm mouth diameter, a height of 260 mm, and a short side width of 120 mm. Based upon the above conditions, an exemplary bottle was designed.

Figure 7A:
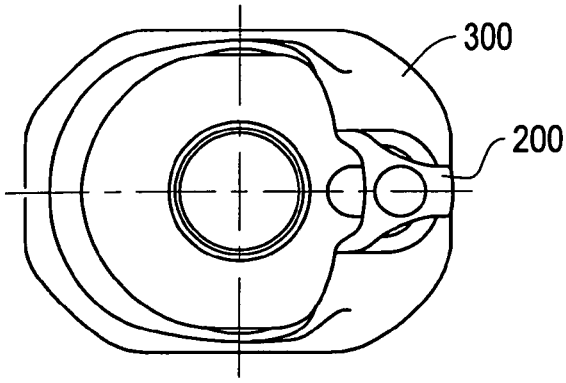
FIGS. 7A, 7B and 7C are side, end, and top views, respectively, of a blown 96 oz. bottle formed from the preform of FIG. 6A according to a second embodiment of the invention.
Figure 7B:
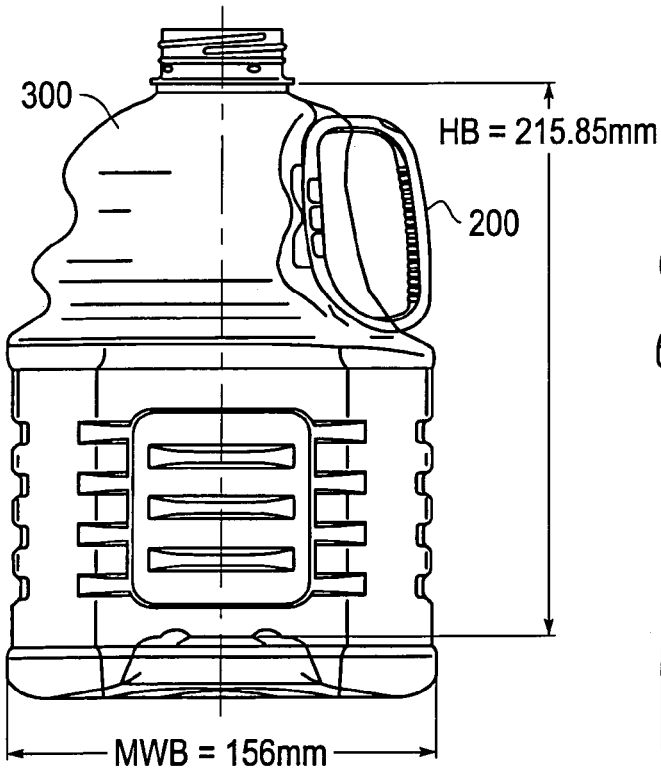
Figure 7C:
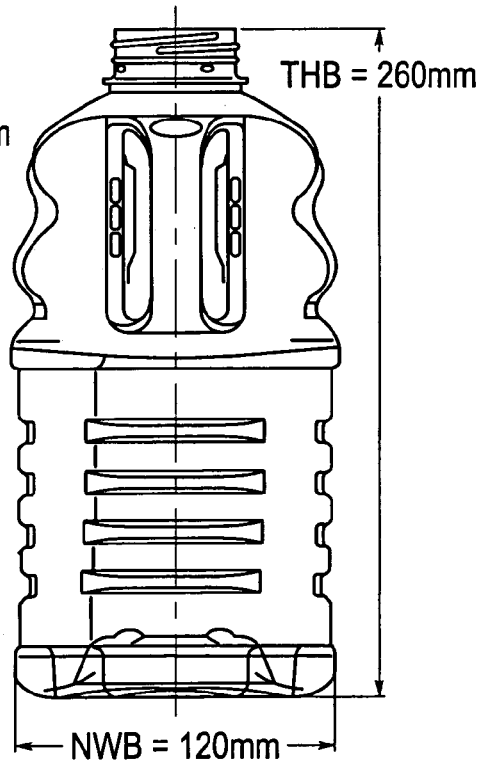

The bottle in FIGS. 7A–C satisfies all the requirements demanded by customers, including a height of 260 mm (which is less than the maximum of 265 mm needed to fit on a conventional 64 oz. shelf), and with 120×156 mm sides (which provides a short side able to fit in the 120 mm wide refrigerator side shelves). This exemplary bottle resulted in a vertical expansion ratio of 2.0 (215.85/108) and a horizontal expansion ratio of 3.48 (156/44.87). These expansion ratios are also appropriate, allowing sufficient moldability. However, the bottle is not limited to these specific rectangular sizes. Other rectangular side lengths can be used. In hot-fill applications, the horizontal expansion ratio should be between 3.0 to 4.0:1 in each of the major and minor directions.

Applicants predicted that rigidity of the rectangular bottle would be weak compared to a round bottle. Therefore, in addition to the 110-gram preform of FIG. 6A used to form the bottle in FIGS. 7A–C, a 115-gram preform was also designed, which retained a preform diameter of 44.87 mm, but had a below mouth length of 116.68 mm rather than 108 mm. This alternative example resulted in a vertical expansion ration of 1.85 (215.85/116.68) and a horizontal expansion ratio of 3.48 (156/44.87). While the vertical expansion ratio decreased from the bottle of FIG. 7, it was still within a range where there was no problem.

Based upon the above results, a metal blow mold was manufactured, and blow-molding was performed with two types of preforms.

Figure 1:
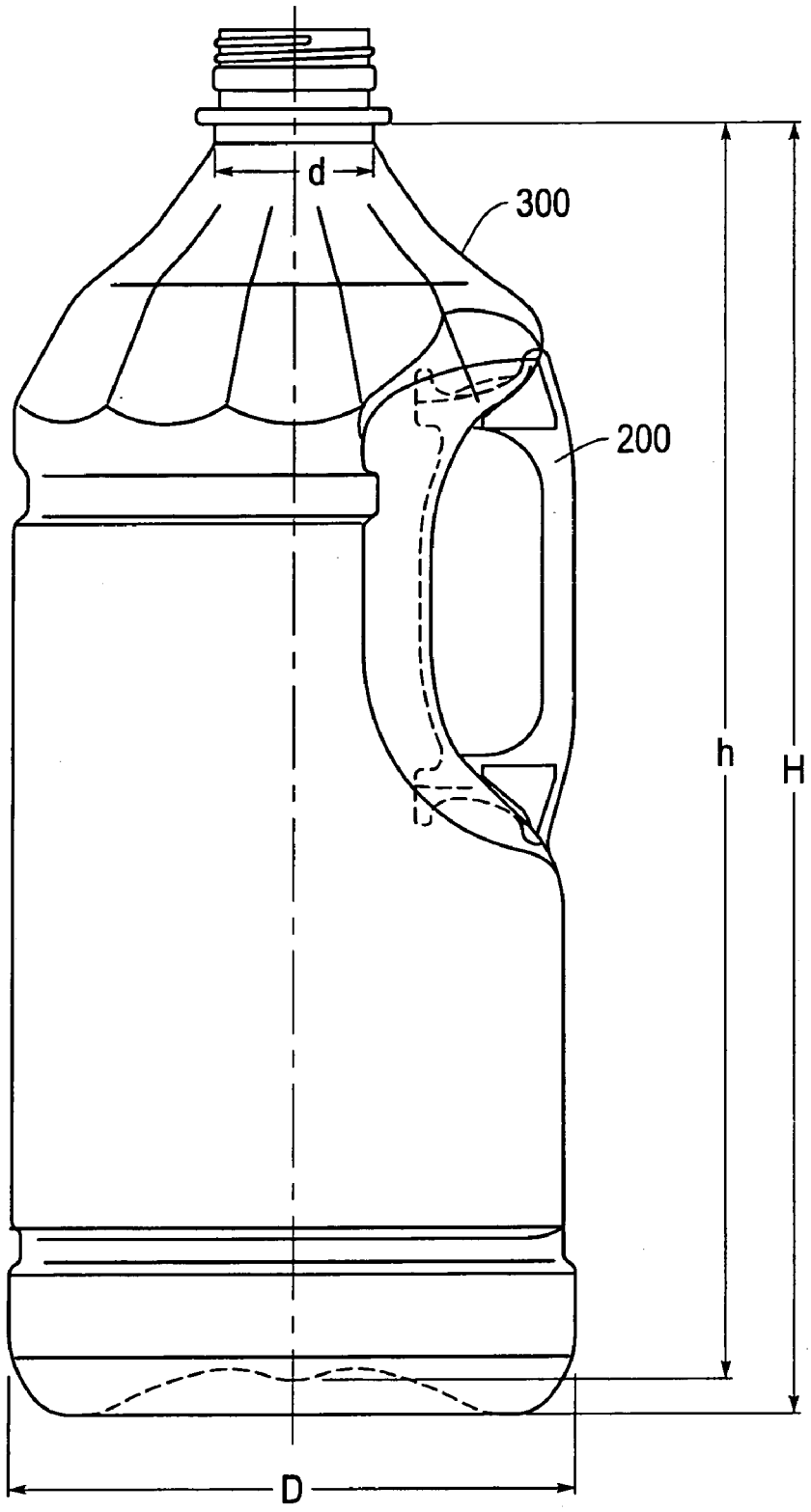
FIG. 1 is side view of a blow-molded plastic bottle with an insert-type handle.
Figure 2:
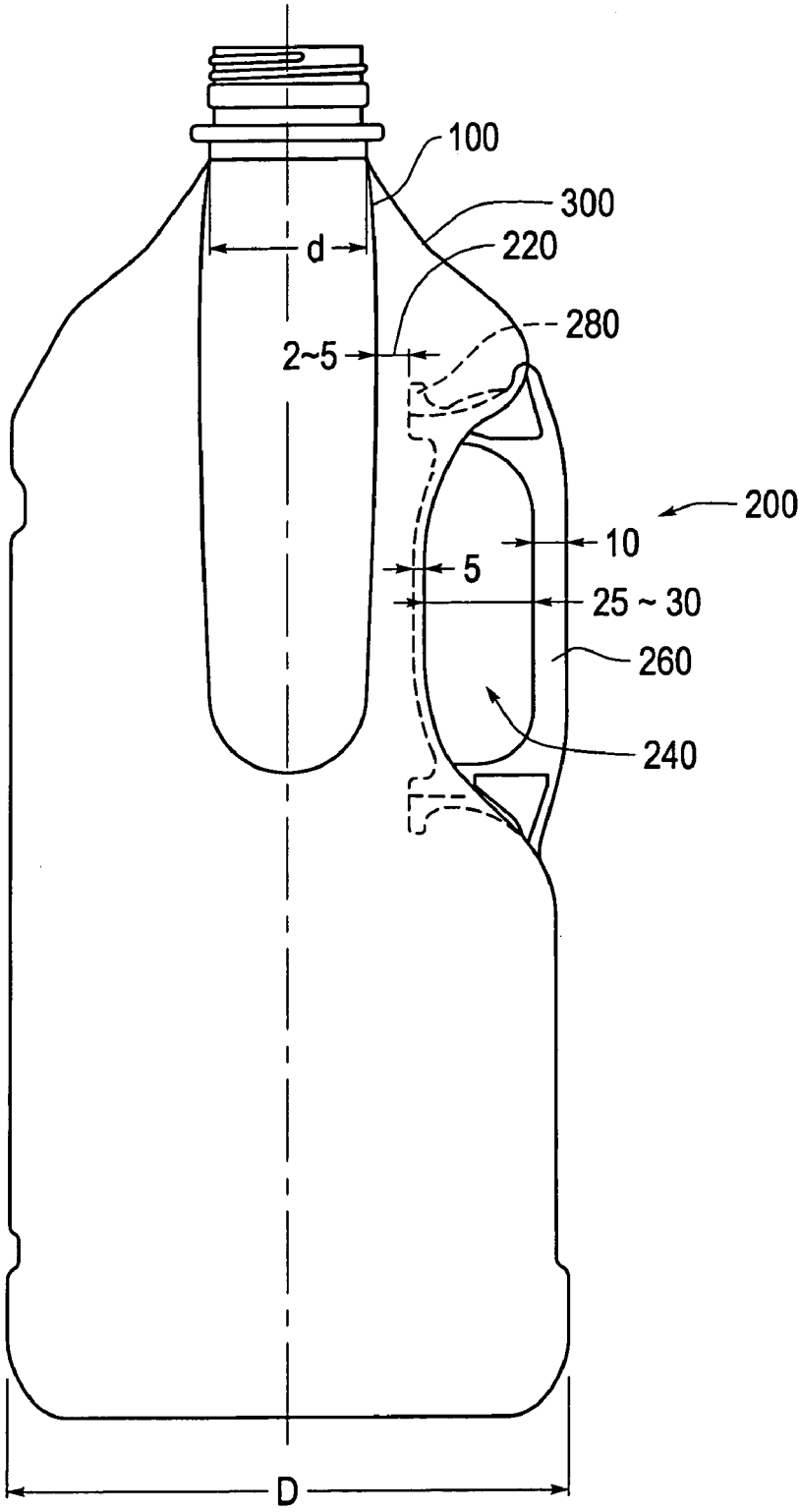
FIG. 2 is a cross-sectional view of the bottle with insert-type handle of FIG. 1 and a preform used to blow-mold the bottle showing various spacing dimensions between elements.
Figure 3:
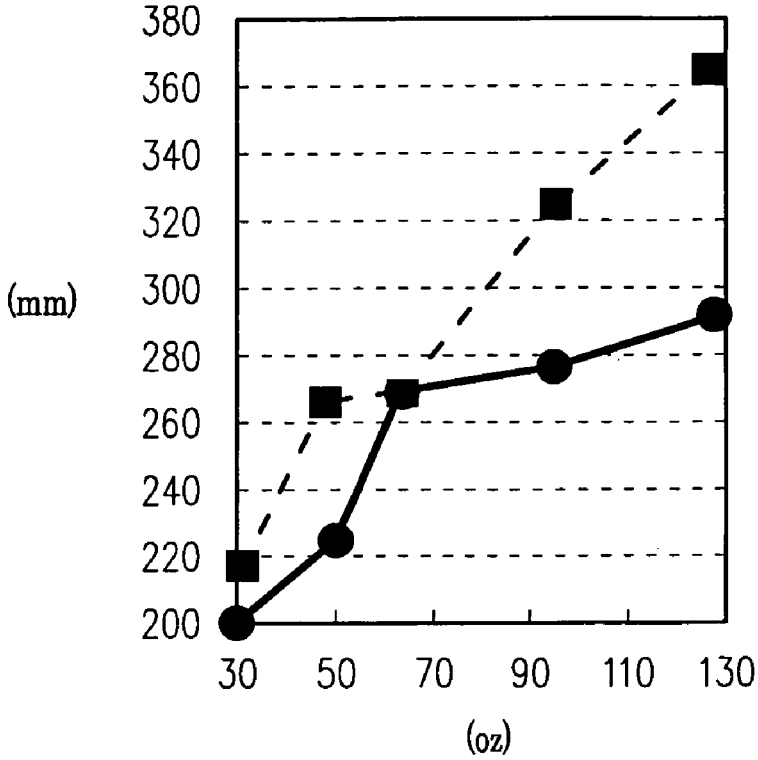
FIG. 3 is a graph representing current bottle heights for various sizes and preferable heights from the stand point of moldability.
Figure 4:
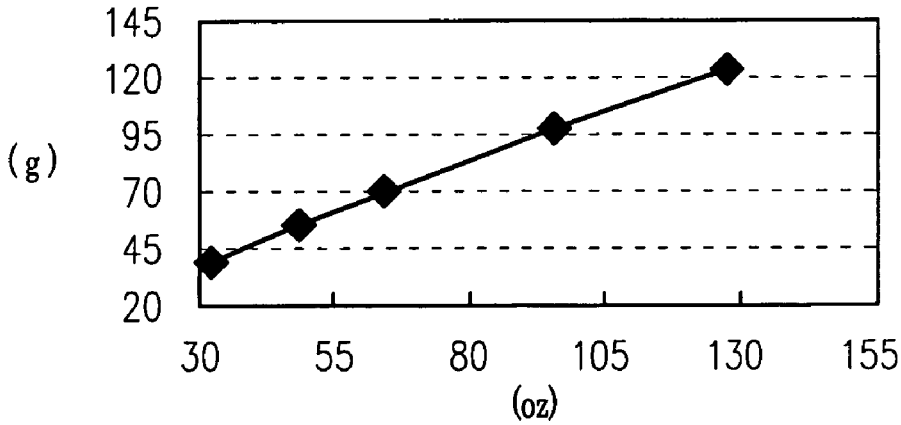
FIG. 4 is a graph showing the relationship between bottle volume and weight.

First, preform 100 was heated to approximately 110° C. Then, insert-type handle 200 and preform 100 were simultaneously placed into a metal mold and the preform 100 was blow-molded for approximately three seconds at a blow pressure of 30 kg/cm$^2$ and a mold temperature of 120° C. The preform 100 and handle 200 were placed so as to meet the requirements of FIG. 2 (i.e., spacing of at least 2 mm). When the molded bottle 300 was taken out at the mold temperature as-is, the bottle became deformed. To remedy this, the molding process was modified to cool down the bottle from the inside for approximately 1 second at room temperature before taking the bottle out from the metal mold. After this, and before the bottle received additional heat from the metal mold, the bottle was instantly taken out from the metal mold. This made it possible to take the bottle out with substantially no deformation.

The formed bottle was sufficiently heat-resistant at 82° C. or more and showed almost no deformation after it was filled with liquid.

The above conditions are only one example, and vary depending upon the use of the bottle. Furthermore, by changing the molding conditions, it is possible to achieve either high temperature filling or room temperature filling of the bottle.

Another aspect of the invention is to provide a proper shape of the insert-type handle 200 for bottle 300. The first and second aspects primarily were concerned with the shape of the preform 100 and bottle 300, however, the shape of the handle 200 is also important.

FIGS. 8A–F show three types of handle shapes. The Y-type handle is exemplified by the handle provided in U.S. Design Pat. No. 402,895. The KD and D-types are exemplified by the handles provided in U.S. Pat. No. 5,819,966. With respect to a long bottle with a H/D ratio of 2 or more, the bottle-engaging part 280 of an insert-type handle, such as the KD and D types, is in the same direction as a center axis of the bottle. This is good for a bottle with a long measurement. However, in the case of a short bottle, a KD or D type handle can be extremely inconvenient because the length of the handle in the vertical direction can become long if the engaging part is included. If the handle becomes long, the label width accordingly becomes narrow. If the current label width needs to be maintained, the handle 200 has to be made short. However, if too short, it may be impossible to insert all four fingers into the handle.

Therefore, a Y type handle 200 in which the engaging part 280 of the bottle is not above and below (outside of) the handle, but rather is inside the handle, has been found to be extremely convenient when such a short bottle is formed. However, this applies to a situation in which a label is applied over the entire circumference. In the case of a spot label, there is no problem with KD and D-type handles.

Thus, in the case of the circumference label, a Y type handle 200 is used, and in the case of a spot label, the handle type is not limited. With respect to the basic bottle design, there is no change in the shape of the handle.

In all of the above illustrative examples, it may be desirable to add one or more reinforcement ribs or collapse panels on one or more sides as shown in the drawings to resist deformation of the bottle. It may also be desirable to add one or more reinforcing grooves around all or part of the upper half of the bottle below the mouth as shown.

The invention has been described with reference to exemplary embodiments, which are meant to be illustrative and not limiting. Modifications can be made without departing from the spirit and scope of the invention. For example, while vertical expansion ratios of above 1.8 and horizontal expansion ratios of between 3.0 to 4.0 are believed necessary to provide proper heat resistance in a hot fill application, bottles that do not require heat resistance can be formed with expansion ratios outside of these ranges, for example a horizontal expansion ratio of about 2.0:1. Moreover, if greater or lesser heat resistance is needed, the temperature of the molding process can be appropriately adjusted.

What is claimed is:

1. A method of blow-molding a bottle formed with an insert-type handle, a capacity of at least about 64 ounces, a height to width ratio of less than 2:1, and a height of less than 265 mm, the method comprising:

providing a preform having a thickness of less than about 5 mm, a neck diameter of between 38 and 48 mm, a preform weight in grams that substantially conforms to the equation $Y=0.878X+12.08$ where Y is the weight and X is the volume of the bottle, and a predetermined axial length;

providing the insert-type handle;

placing the insert-type handle and the preform into a metal mold with an axial spacing between the preform and the handle;

blowing the preform at a predetermined temperature and pressure to expand the preform by a vertical expansion ratio of about 2:1 and a horizontal expansion ratio of at least approximately 2:1 against the insert-type handle and metal mold to form the bottle having an insert-type handle, a capacity of at least about 64 ounces, a height to width ratio of less than 2:1, and a height of less than 265 mm; and removing the thus-formed bottle from the metal mold.

2. The method of claim 1, wherein the preform is heated to approximately 110° C.

3. The method of claim 1, wherein the preform is blown for approximately 3 seconds.

4. The method of claim 1, wherein the preform is blown at a pressure of about 30 $kg/cm^2$.

5. The method of claim 1, wherein the mold has predetermined interior dimensions that form the bottle with a height, a width, and a depth, at least one of the width and depth being less than 120 mm.

6. The method of claim 5, wherein the horizontal expansion ratio is at least 3.0:1 in both minor and major directions.

7. The method of claim 1, wherein the vertical expansion ratio is between 1.8:1 and 2.3:1.

8. The method of claim 1, wherein the vertical expansion ratio is at least 1.84:1.

9. The method of claim 1, wherein the insert-type handle is a Y-type handle having an engaging part provided intermediate axial ends of the handle.

10. The method of claim 9, wherein the insert-type handle has a depth of between about 35 to 45 mm.

11. The method of claim 1, wherein the predetermined temperature is sufficient to give the bottle heat resistance of at least 82° C.

12. The method of claim 1, further comprising a step of cooling the blown bottle prior to removal of the bottle from the mold.

13. The method of claim 1, wherein the volume of the thus-formed bottle is approximately 96 ounces.

14. The method of claim 1, wherein the volume of the thus-formed bottle is approximately 128 ounces.

15. The method of claim 1, wherein the insert-type handle has a total depth of between 35–45 mm.

16. The method of claim 1, wherein the insert-type handle is oriented substantially in line with a maximum width of the thus-formed bottle.

17. The method of claim 1, wherein the thus-formed bottle is blown to have an axial cross-section below the handle that is substantially rectangular.

18. The method of claim 17, wherein a shortest side of the substantially rectangular cross-section is no more than 120 mm.

19. The method of claim 17, wherein a longest side of the substantially rectangular cross-section is about 156 mm.

20. A method of blow-molding a bottle formed with an insert-type handle and having a capacity of at least about 64 ounces and a height to width ratio of less than 2:1, the method comprising:

providing a preform having a predetermined thickness, a predetermined neck diameter of between 38 and 48 mm, a preform weight in grams that substantially conforms to the equation Y=0.878X+12.08 where Y is the weight and X is the volume of the bottle, and a predetermined axial length;

providing an insert-type handle;

placing the insert-type handle and the preform into a metal mold with an axial spacing between the preform and the handle;

blowing the preform at a predetermined temperature and pressure to expand the preform by a vertical expansion ratio of about 2:1 and a horizontal expansion ratio of at least approximately 2:1 against the insert-type handle and metal mold to form the bottle having an insert-type handle, a volume of at least 64 ounces and a height to width ratio of less than 2:1; and removing the thus-formed bottle from the metal mold.

21. A method of blow-molding a heat-resistant bottle formed with an insert-type handle suitable for hot-fill applications having a heat resistance of at least 82° C., a capacity of at least about 64 ounces, and a height to width ratio of less than 2:1, the method comprising:

providing a preform having a predetermined thickness, a predetermined neck diameter of between 38 and 48 mm, a preform weight in grams that substantially conforms to the equation Y=0.878X+12.08 where Y is the weight and X is the volume of the bottle, and a predetermined axial length;

providing an insert-type handle;

placing the insert-type handle and the preform into a metal mold with an axial spacing between the preform and the handle;

blowing the preform at a predetermined temperature and pressure to expand the preform by a vertical expansion ratio of about 2:1 and a horizontal expansion ratio of at least approximately 2:1 against the insert-type handle and metal mold to form the bottle having an insert-type handle, a volume of at least 64 ounces, a height to width ratio of less than 2:1, and heat resistance of at least 82°; and removing the thus-formed bottle from the metal mold.

* * * * *